US005178600A

United States Patent [19]

Harder

[11] Patent Number: 5,178,600

[45] Date of Patent: Jan. 12, 1993

[54] TUCK FOLDER BOX ERECTION FIXTURE

[75] Inventor: Melvin S. Harder, Santa Clara, Calif.

[73] Assignee: Rolm Systems, Santa Clara, Calif.

[21] Appl. No.: 871,184

[22] Filed: Apr. 20, 1992

[51] Int. Cl.[5] ..... B31B 3/02; B31B 3/26

[52] U.S. Cl. ..... 493/162; 493/52; 493/167; 493/468

[58] Field of Search ..... 493/52, 162, 167, 468

[56] References Cited

U.S. PATENT DOCUMENTS

| | | | |
|---|---|---|---|
| 1,054,521 | 2/1913 | Ellis | 493/52 |
| 2,826,969 | 3/1958 | Wasyluka et al. | 493/468 |
| 3,260,174 | 7/1966 | Pierce | 493/167 |
| 3,469,508 | 9/1969 | Klapp | 493/164 |
| 3,511,140 | 5/1970 | Hoyrup | 493/167 |
| 3,626,819 | 12/1971 | Hoyrup | 493/167 |
| 3,800,681 | 4/1974 | Corderoy | 493/167 |
| 4,006,670 | 12/1974 | Royal | 493/10 |
| 4,206,691 | 2/1978 | Lines | 493/162 |
| 4,240,337 | 12/1980 | Casutt | 493/137 |
| 4,915,678 | 9/1987 | Morita | 493/116 |

*Primary Examiner*—William E. Terrell
*Attorney, Agent, or Firm*—Michael B. Einschlag

[57] ABSTRACT

A tuck folder box erection fixture which quickly erects the box blank and holds the erected folder in place while the packaging operator loads the product. In particular, an inventive fixture that is stationary and uses no moving parts to erect and hold the box in place.

1 Claim, 6 Drawing Sheets

TUCK FOLDER BOX ERECTION FIXTURE

BACKGROUND OF THE INVENTION

This invention relates to the design of a tuck folder box erection fixture. The purpose of the erection fixture is to reduce the amount of time necessary to erect a box and hold the box in place so the product can be easily loaded.

Prior art is to erect the box by hand or use a piece of expensive, bulky and complicated machinery. The manual box erection procedure is cumbersome, time consuming and tiring for the operator. The box erection machinery is prone to jams, equipment mis-alignment, and inability to handle variations in the corrugated material.

In the art today there is a need for an inexpensive fixture, with no moving parts, that will assist an operator to erect a tuck folder box quickly and efficiently without any jams due to material variances.

SUMMARY OF THE INVENTION

The tuck folder box (See FIGS. 2 and 3) is a one piece construction box which eliminates the need for a manufacturers joint. In addition, the tuck folder uses the least amount of corrugated board to form a box which makes it the most efficient box style. The problem with the tuck folder is that it is very difficult box to erect by hand and some type of retaining device is needed to hold the box open while the product is loaded. After the product is loaded, the end of the lid 33 can be tucked inside the front panel 31 which will secure the box and insure its integrity and closure.

To achieve the goals of speed, efficiency, robustness, and reliability a box erection fixture was designed with no moving parts (See FIG. 1). The key to the design of the box erection fixture was the selection and timing of the flap and panel movement. The outer flaps 28 needed to be bent first so four posts 22 were designed to be 6.5 inches high and positioned so they were centered underneath each flap. The next to be bent up were the side panels of the folder 29 so when the front and back panels 30 and 31 came up the outer flaps would not catch on the corrugated sides and jam. This was accomplished by making the side erection fixture walls 24 5 inches high and angling them at 50 and 130 degrees respectively. The next and final panels to bend up were the front and back 30 and 31. This was accomplished by making the front and back erection fixture walls 23 4 inches high with an angle of 60 and 120 degrees respectively. The final requirement is to hold box erect and this was accomplished by sinking a hole 25 1½ inches deep straight down into the bottom. To aid in cleaning and prevent air from being trapped in the bottom of the fixture, the corners were cut out 26 and a 2 inch diameter hole was put in the center 27. The surface of the erection fixture was made of Formica to insure the box exterior would not be scratched or scuffed. The supports were make of wood and angle brackets.

The box erection fixture was sunk into the packaging work station in front of the packaging operator. The box blanks were shipped to the factory flat and would be stacked just opposite of the packaging operator. The operator would pull the next box blank toward him and place it over the box erection fixture. Next, he would push the blank forward until it was positioned by the two large locater pins 21 at the head of the fixture. Then he would push on the center of the blank until it hit the bottom and the fixture would erect the box and hold it in position until after the product was loaded. When the operator closed the lid 32, the box could be lifted out and placed on the shipment pallet (See FIG. 4). In this case, the box erection fixture reduced the box erection time from 10 to 2 seconds. An experience operator could select, position, and erect a box in less than a second.

The selection and timing of the box flap and panel movement principles could be used to design a fixture that would quickly erect, and hold in place, any size tuck folder.

A further understanding of the nature and advantages of the present invention many be realized by reference to the remaining portion of the specification and drawings.

BRIEF DESCRIPTION OF THE DRAWINGS

A complete understanding of the present invention may be gained by considering the following detailed description in conjunction with the accompanying drawings, in which.

REFERENCED NUMERALS IN DRAWINGS

Figure 1:
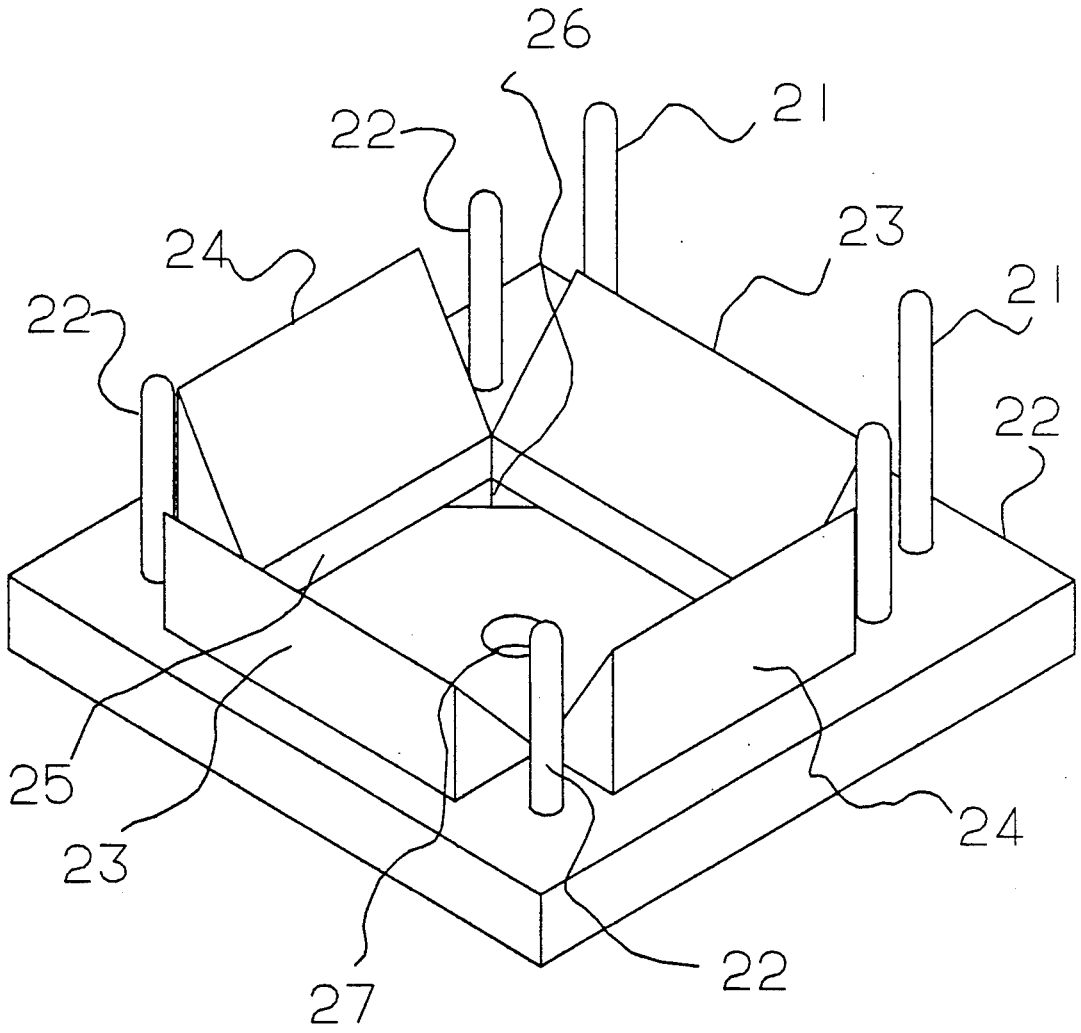
FIG. 1 shows, in pictorial form, the invention.

21: Large box blank locator pins
22: Pins for bending the box flaps
23: Front and Back fixture walls
24: Side fixture walls
25: Hole to hold the box in place
26: Cut out to aid cleaning
27: Hole in center to relieve air pressure
28: Box flaps
29: Side Panels
30: Back Panel
31: Front Panel
32: Lid
33: Lid end
34: Top View of the invention
35: Front View of the invention
36: Right Side View of the invention
37: Isometric View of the invention.

DETAILED DESCRIPTION OF THE REFERRED EMBODIMENTS

FIG. 1 shows an isometric view of the invention. The two large locator pins 21 position the box blank (See FIG. 2) over the fixture. The four box flap pins 22 engage the box blank first as it is being pushed downward to bend the flaps up. The side fixture walls 24 engage the box blank next to bend the side panels up. Lastly the back and front fixture walls 23 engage the box blank to bend up the front and back panels. Finally the folded box blank sinks unto the recess 25 to hold the erected box in position for loading.

Figure 2:
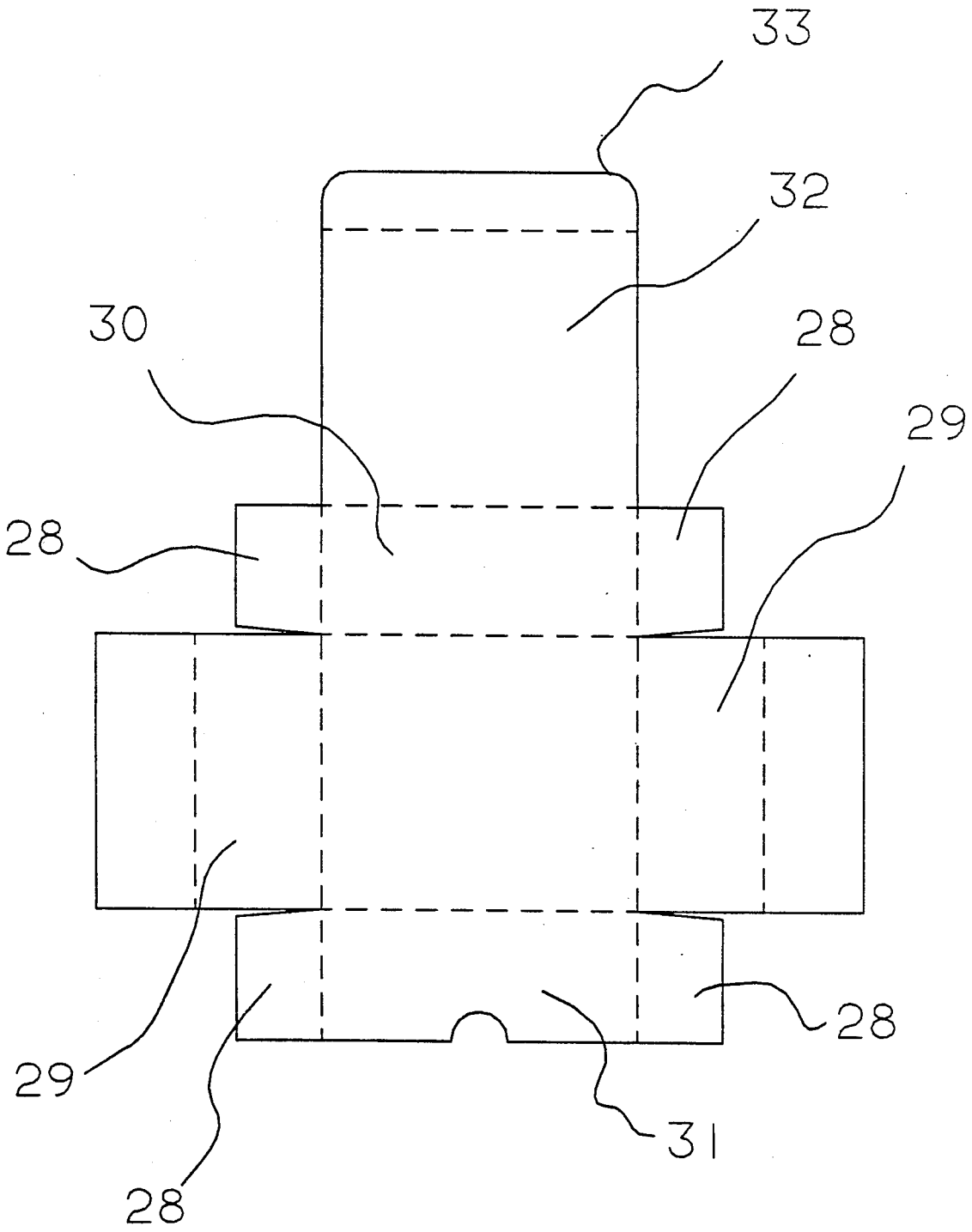
FIG. 2 shows, the box blank layout of a tuck folder.

FIG. 2 shows a box blank layout of a tuck folder box. The box blank consists of box flaps 28, side panels 29, front panel 30, back panel 31, lid 32, and lid end 33. It is made with the use of a die cut mold made out of wood and set with steel knives and plates to cut and crease the corrugated sheet.

Figure 3:
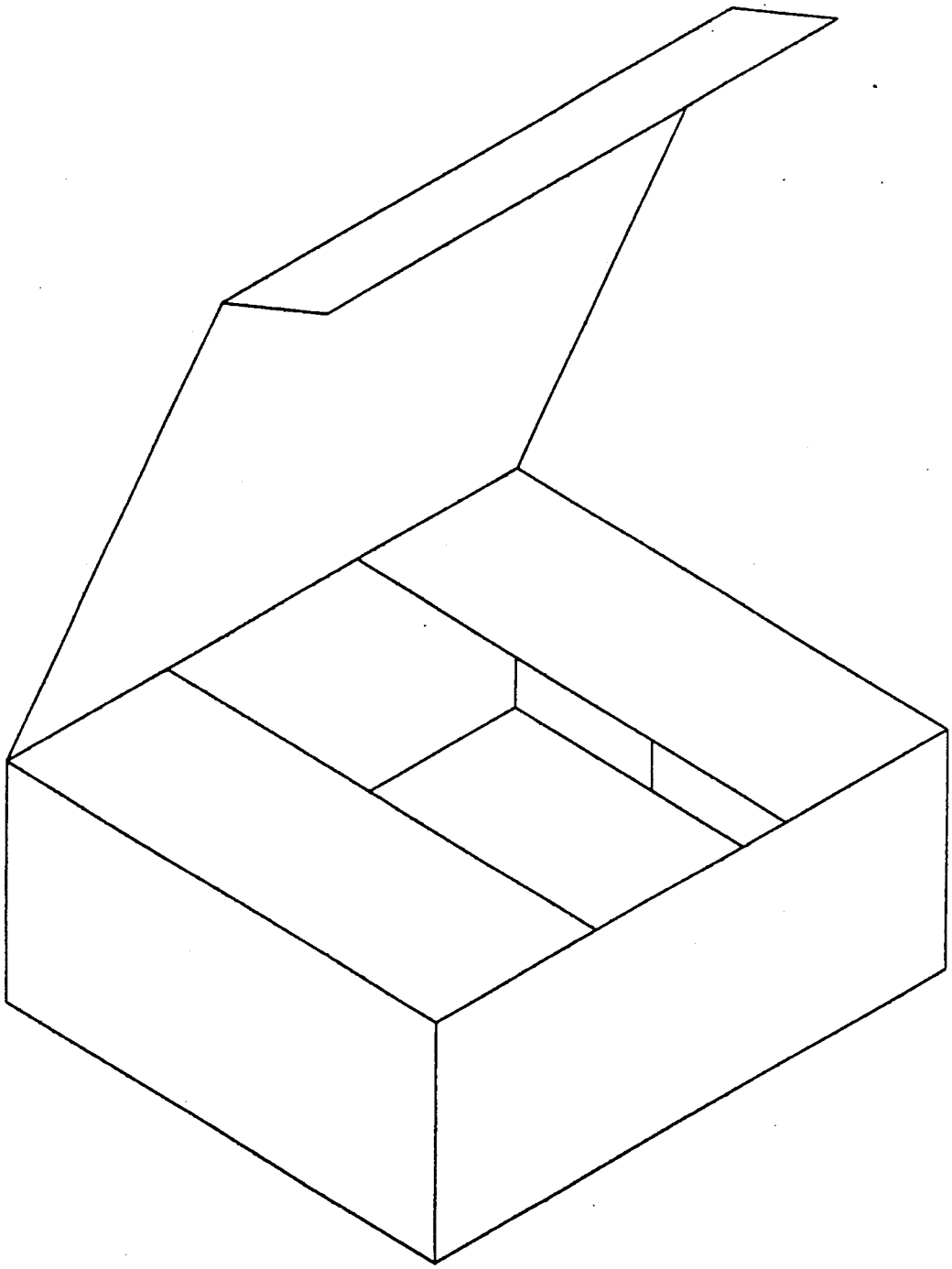
FIG. 3 shows, in pictorial form, the assembled box.

FIG. 3 shows a pictorial view of the tuck folder in its assembled state. The lid needs to be tucked inside the front panel in order for the box to maintain its integrity and closure.

Figure 4A:
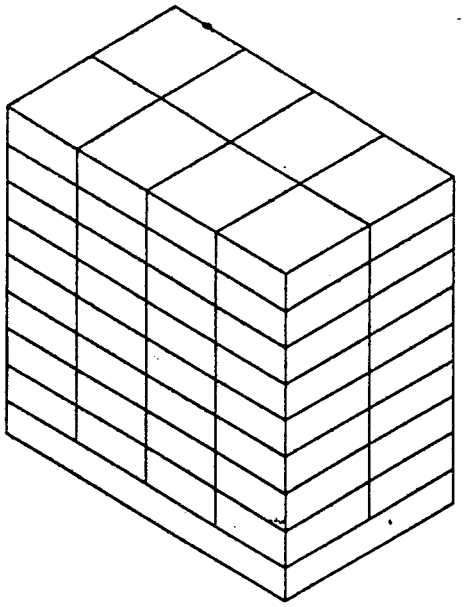
FIG. 4, (*a* and *b*) show, in pictorial form, the pallet patterns.
Figure 4B:
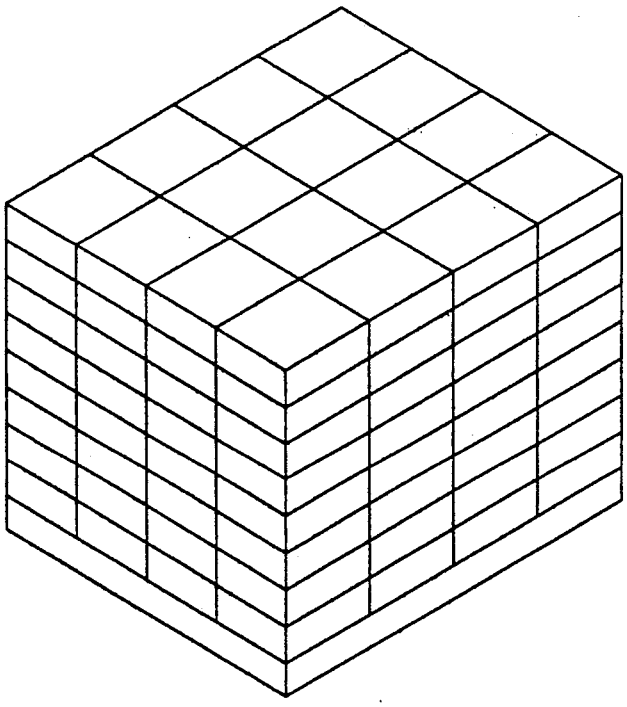
Figure 5A:
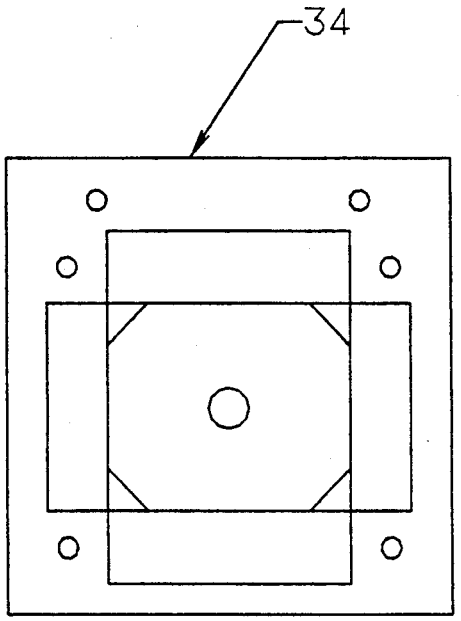
FIGS. 5, (*a, b, c* and *d*) show, three views of the invention (Top, Front, Right Side) and an isometric view.
Figure 5B:
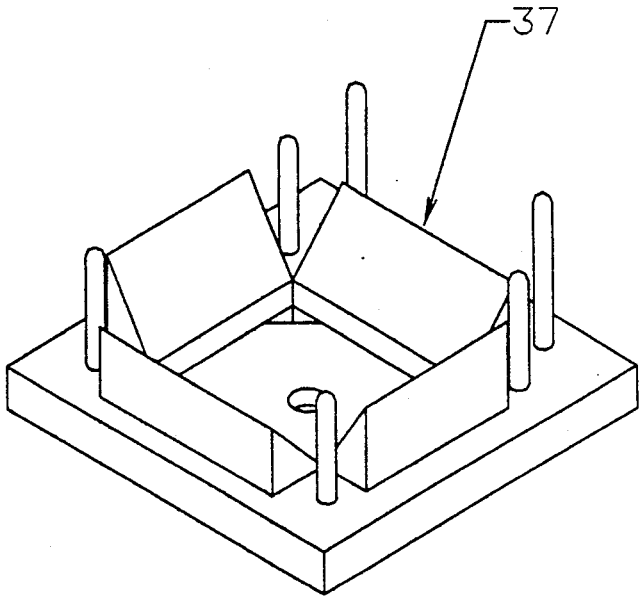
Figure 5C:
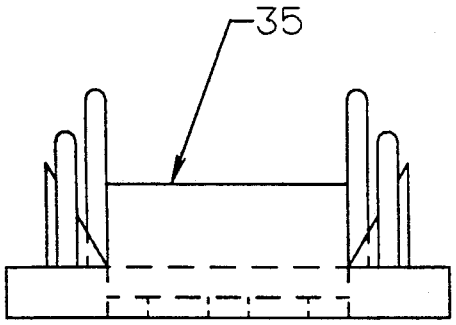
Figure 5D:
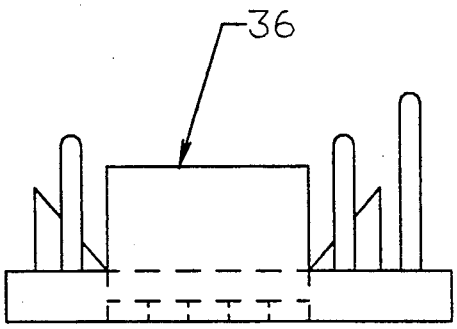

FIG. 4 shows the pallet patterns of the box when it is erected and loaded on to both the 40 inch×24 inch pallet and the 40 inch×48 inch pallet.

FIG. 5 shows the three views of the invention (Top, Front, Right Side) and the isometric view.

Figure 6:
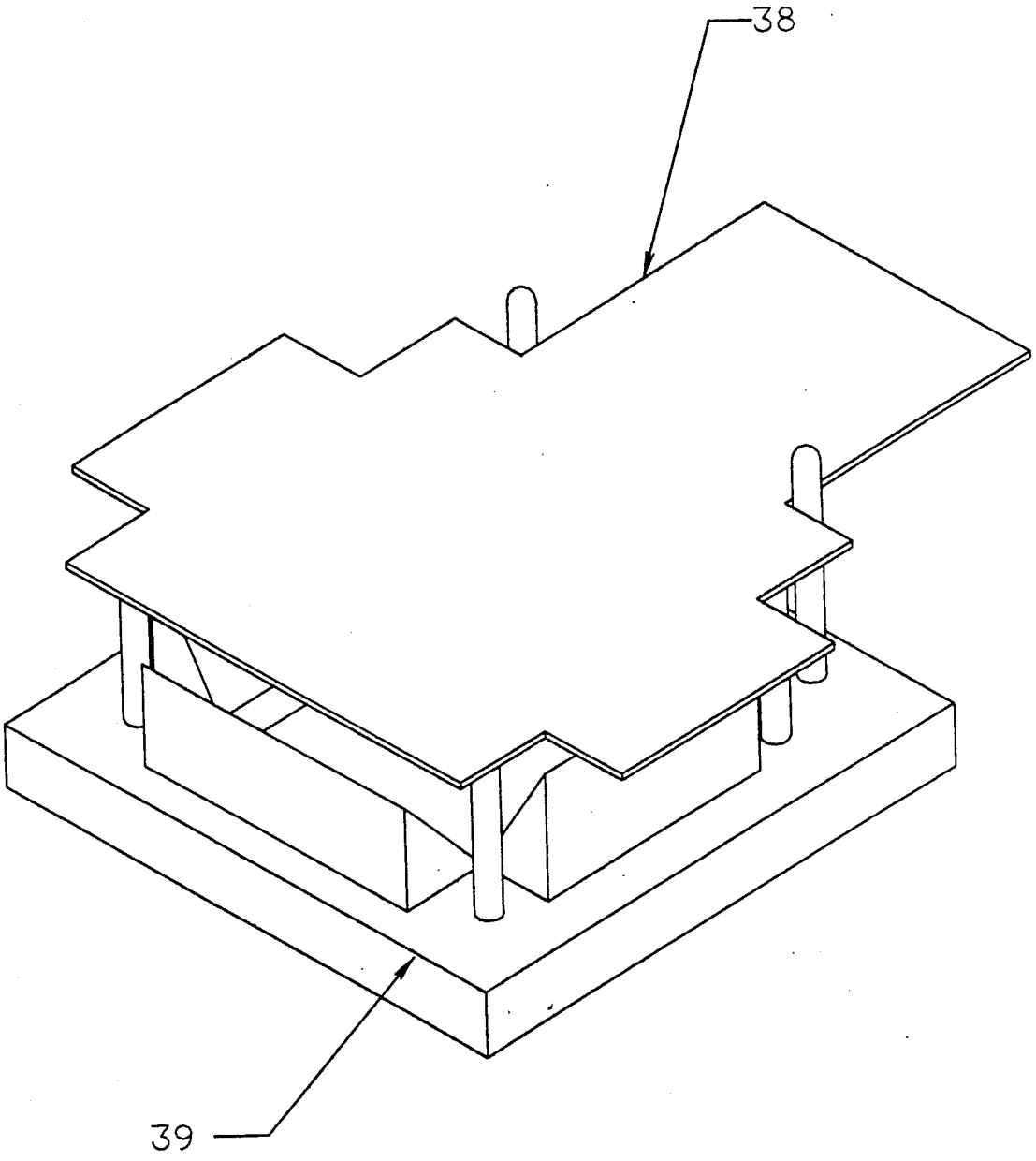
FIG. 6 shows, pictures of the actual operation of the fixture.

FIG. 6 shows, in picture form, the operations necessary to erect the tuck folder box. Step 1—position box blank over fixture; Step 2—push downward until the blank hits the bottom of the fixture; Step 3—load product in the box; Step 4—fold side flaps inward; Step 5—fold lid forward; Step 6—fold lid end inside front panel; Step 7—lift loaded and erected box out of fixture and place it on a shipment pallet.

What is claimed is:

1. A stationary tuck folder box erection fixture for erecting a box blank having side panels, front and back panels, and box flaps, comprising:

a) two large locating posts for locating the box blank;

b) four box flap posts for bending the box flaps;

c) a pair of side walls having two surfaces respectively angled at substantially 130 and 50 degrees to the horizontal for bending the side panels;

d) a pair of front and back walls having two surfaces angled at substantially 60 and 120 degrees to the horizontal for bending the front and back panels; and e) means defining a recessed center portion for holding the box in place while loading a product;

f) said side walls being higher than said front and back walls;

g) said box flap posts being higher than both said side walls and said front and back walls.

* * * * *